US005154193A

United States Patent [19]

Busch et al.

[11] Patent Number: 5,154,193

[45] Date of Patent: Oct. 13, 1992

[54] CONTINUOUS HAIR DYE DISPENSING DEVICE

[75] Inventors: Peter Busch, Erkrath; Klaus Thiele, Langenfeld, both of Fed. Rep. of Germany

[73] Assignee: Henkel Kommanditgesellschaft auf Aktien, Duesseldorf, Fed. Rep. of Germany

[21] Appl. No.: 549,020

[22] PCT Filed: Mar. 13, 1989

[86] PCT No.: PCT/EP89/00263

§ 371 Date: Sep. 20, 1990

§ 102(e) Date: Sep. 20, 1990

[87] PCT Pub. No.: WO89/08999

PCT Pub. Date: Oct. 5, 1989

[30] Foreign Application Priority Data

Mar. 22, 1988 [DE] Fed. Rep. of Germany ..... 3809498

[51] Int. Cl.[5] ..... A45D 24/16

[52] U.S. Cl. ..... 132/110; 132/108; 401/199; 401/283

[58] Field of Search ..... 132/108, 109, 110, 111, 132/114, 116, 120, 218, 320; 401/198, 199, 283

[56] References Cited

U.S. PATENT DOCUMENTS

| | | | |
|---|---|---|---|
| 2,140,009 | 12/1938 | Hand | 401/199 |
| 3,089,182 | 5/1963 | Lofgren | 401/199 |
| 3,231,924 | 2/1966 | Lofgren | 401/198 |
| 3,345,674 | 10/1967 | DeGroft | 401/198 |
| 3,369,543 | 2/1968 | Ronco | 401/198 |
| 4,086,312 | 4/1978 | Midorikawa | 401/198 |
| 4,585,018 | 4/1986 | O'Connor | 132/120 |
| 4,589,791 | 5/1986 | Weihrauch | 401/268 |
| 4,822,193 | 4/1989 | Berger | 401/198 |
| 4,838,723 | 6/1989 | Suzuki et al. | 401/198 |
| 4,973,181 | 11/1990 | Jankewitz | 132/320 |

FOREIGN PATENT DOCUMENTS

| | | | |
|---|---|---|---|
| 0097322 | 1/1984 | European Pat. Off. | 401/283 |

*Primary Examiner*—Gene Mancene
*Assistant Examiner*—Frank A. LaViola
*Attorney, Agent, or Firm*—Ernest G. Szoke; Wayne C. Jaeschke; Norvell E. Wisdom, Jr.

[57] ABSTRACT

An improved device for continuous application of a hair dye to a person's hair, without wetting the scalp, incorporates a hair dye reservoir consisting of a first porous material within a housing and teeth made of a second porous material, inserted into the first porous material and in capillary connection with it. The teeth in the surface area of their free ends are free from open pores, and the main pore direction of both the second porous material of the teeth and the first porous material of the reservoir is essentially parallel in the same direction as the longitudinal direction of the teeth. The first porous material of the reservoir extends over several times the penetration depth of the teeth in the penetration direction, and the pore size in the teeth is smaller than in the remainder of the reservoir.

18 Claims, 5 Drawing Sheets

Figure 4:
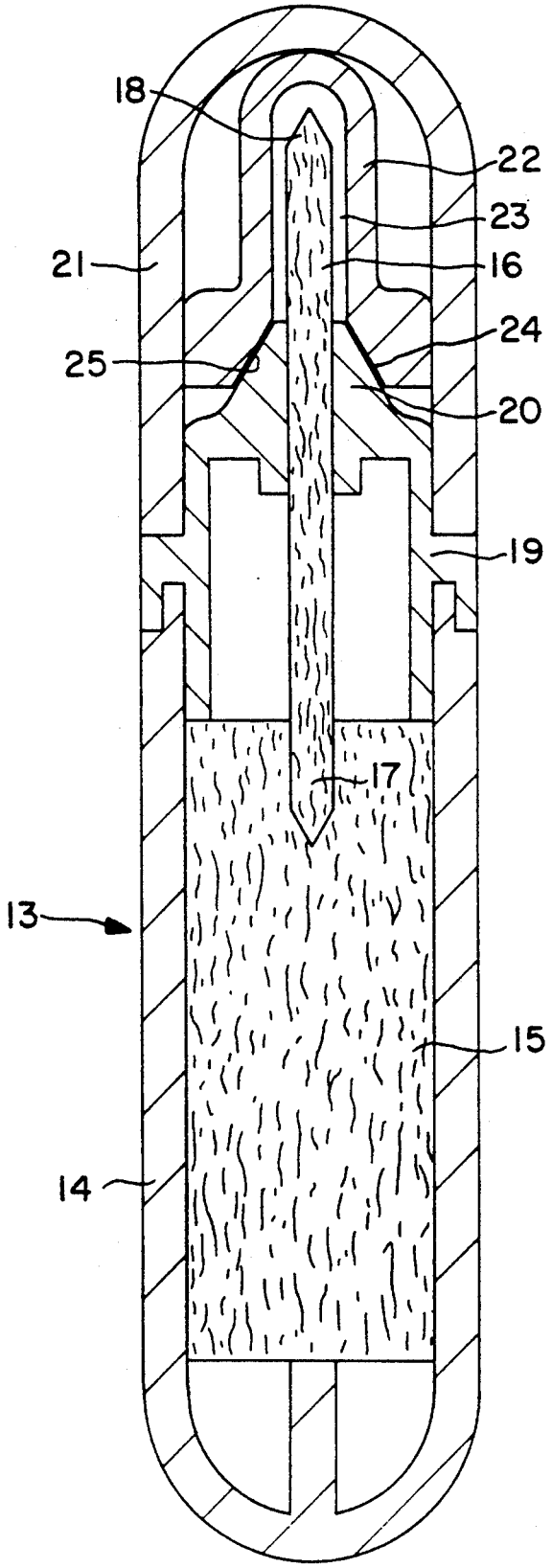

FIG. 1
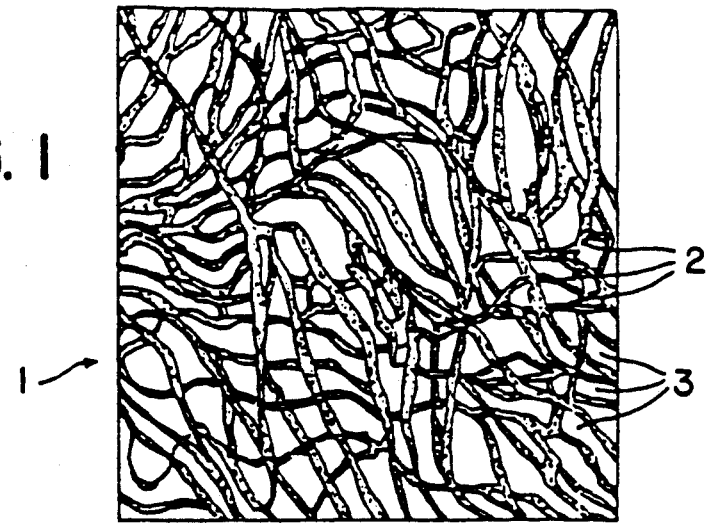
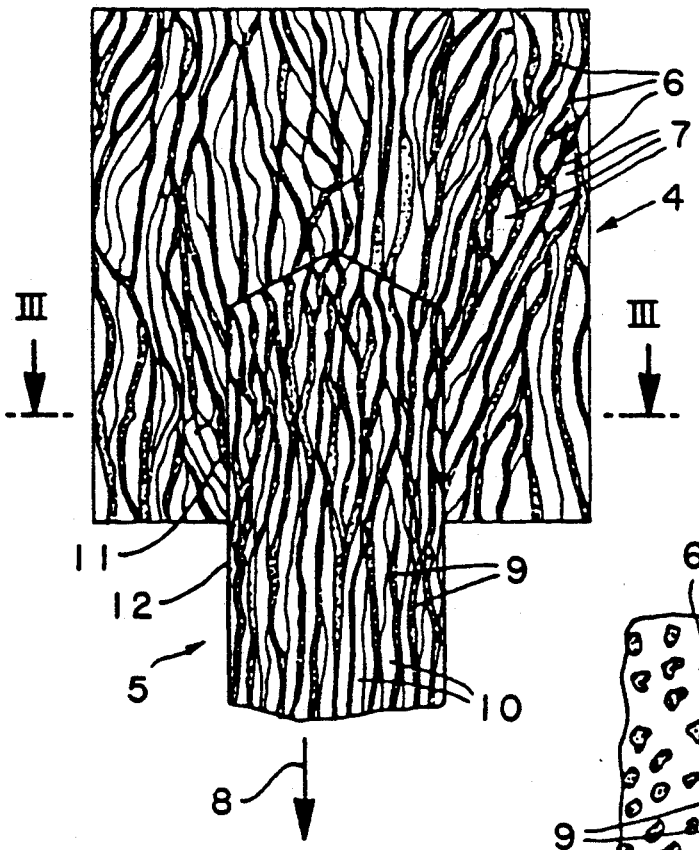
FIG. 2
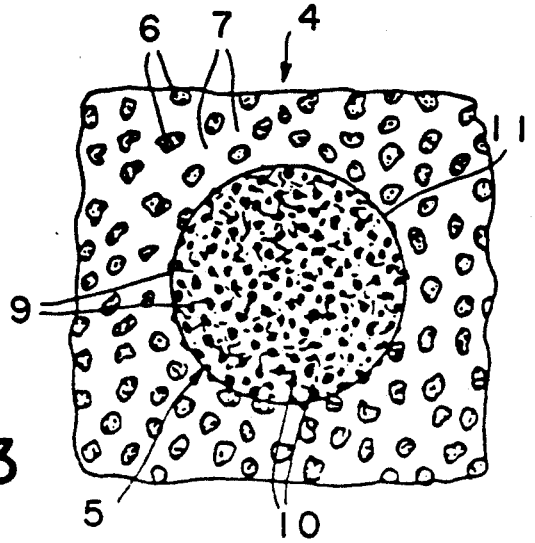
FIG. 3

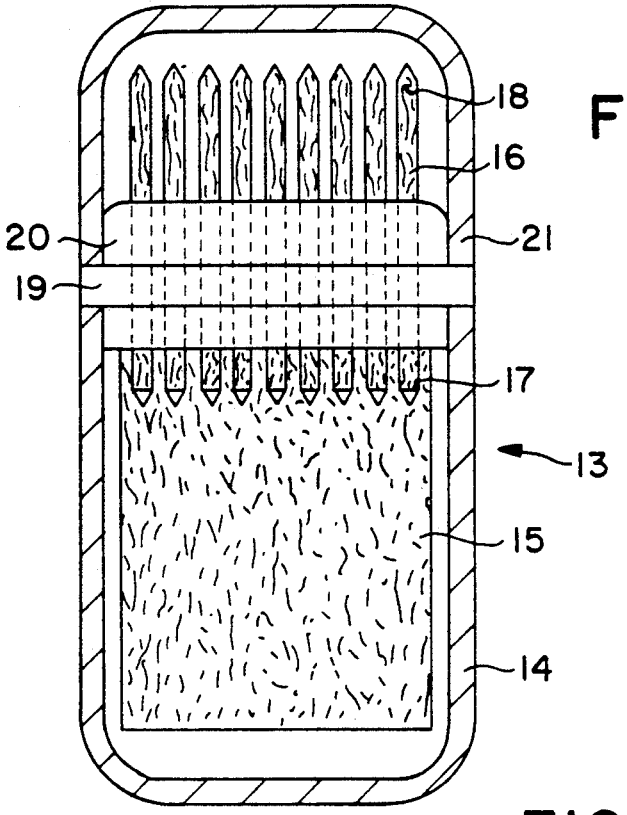
FIG. 5
FIG. 6
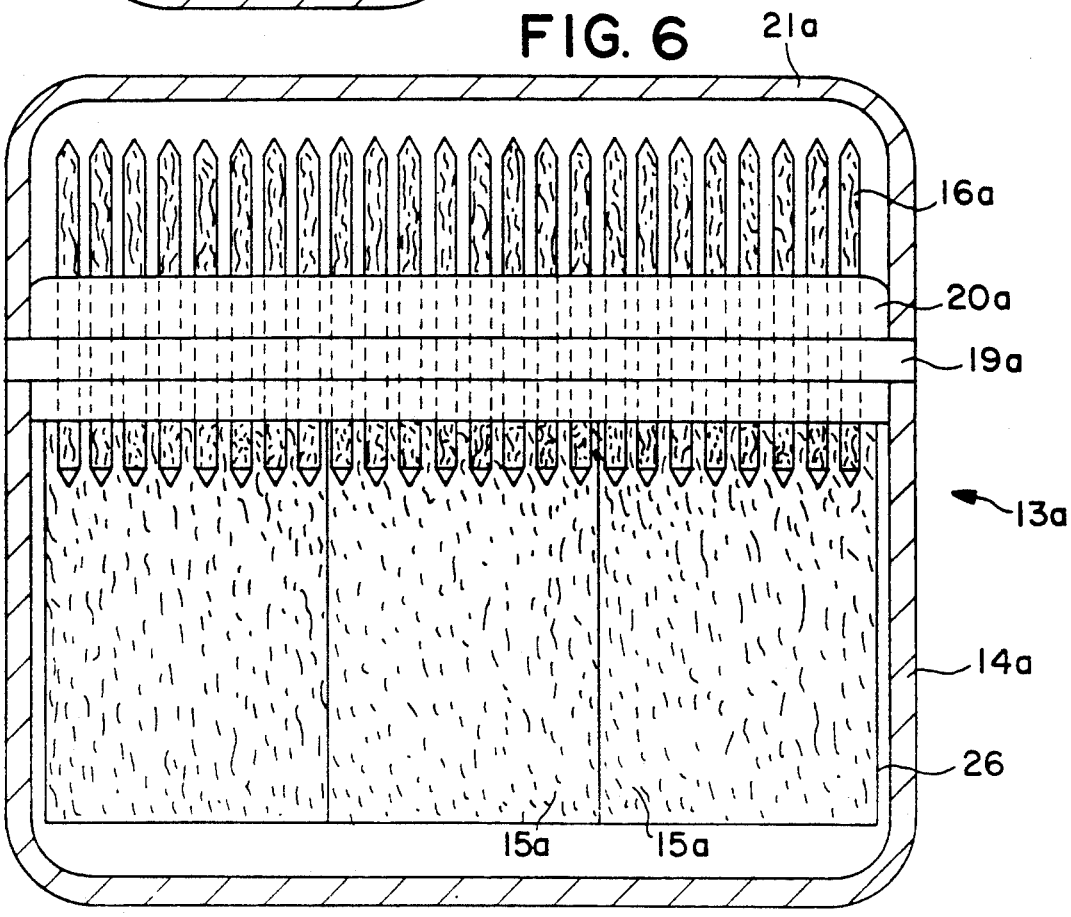

CONTINUOUS HAIR DYE DISPENSING DEVICE

The invention pertains to a device for continuously dispensing a hair dye onto the hair of the human head, said device having a reservoir for the hair dye, made of a first porous material, within a housing, and teeth made of a second porous material, inserted into the first porous material and in capillary connection with it.

A comb for continuously releasing a liquid material onto the hair and scalp of animals or humans is known (EP 0 157 032). This comb has a cavity in a narrow comb back with a hand grip on one side, in which cavity a first porous material for receiving and storing the liquid material is located. A plurality of teeth made of a second porous material, meshing into the first porous material, are in capillary connection with the first porous material, storing the liquid material, in the cavity. As a result, the liquid material can be applied, over the free ends and side surfaces of the teeth, to the hair and especially to the skin. This comb is especially suitable for treating animals with insecticides or the like. To achieve preferred wetting of the skin, the teeth are designed such that the releasing ability of the side surfaces of the teeth is greatly restricted, so that only a relatively small amount of treatment fluid is released.

In treating the hair on the human head with hair cosmetic products, such as hair dyes and the like, however, it is precisely important to avoid wetting the scalp insofar as possible and to release the product as uniformly as possible through the side surfaces of the teeth into the hair, which means release of a larger amount of treatment agent per unit time, and corresponding feeding from the reservoir to and through the releasing teeth. However, these requirements cannot be fulfilled satisfactorily with the above-described comb, since this comb preferentially releases treatment agent onto the skin, and in addition, continuous flow of a larger quantity of treatment agent from the reservoir into the teeth is not assured. This is primarily attributed to the fact that in the known comb, porous materials for the reservoir and the comb teeth are preferentially provided with nonoriented fiber arrangements, and the path of the treatment fluid is unfavorable, even if the comb handle is used as a reservoir for the treatment liquid.

The goal of the invention is that of creating a solution which ensures a reliable and uniform release of liquid hair dyes and the like in an adequate quantity onto the human head hair without wetting the scalp.

This goal is achieved in accordance with the invention with a device of the initially mentioned type in that the teeth, in the surface area of their free ends, are designed with closed pores, and that the main pore direction of the second porous material of the teeth and the first porous material of the reservoir is essentially uniformly parallel to the longitudinal direction of the teeth, wherein the pores of the first porous material are larger than the pores of the second porous material.

As a result of this arrangement, a uniform quantity of hair dye, sufficient for coloring, is released onto the hair of the head without wetting the scalp. In this process, the hair dye can only emerge through the side surfaces of the teeth, since the pores in the surface area of the free ends of the teeth are closed, so that no hair dye can reach the scalp. As a result of the parallel arrangement of the main pore directions of the porous materials of the teeth and the reservoir, a particularly good continuous flow of the hair dye from the reservoir into the teeth is achieved, so that a uniform quantity of hair dye is released at all times, and a correspondingly uniform hair coloring thus results. In addition, as a result of the extension of the first porous material of the reservoir over several times the penetration depth of the teeth in the penetration direction, it becomes possible to store a sufficiently large amount of hair dye, wherein as a result of the short, straight-line transport pathway, the hair dye can flow continuously from the first porous material of the reservoir into the teeth, without a risk of clogging or drying out. In addition, as a result, only a small residual amount of the treatment liquid remains behind unused in the reservoir.

It is especially advantageous if the first porous material of the reservoir and the second porous material of the teeth are formed from nonoriented fibrous material by compression, wherein the compression of the second porous material is greater than that of the first material. As a result of the compression of the original, nonoriented fibrous material, a largely parallel structure of the main fibers develops, so that a main pore direction results. In this process, as a result of the differences in compression of the porous material of the reservoir and the teeth, pores of different size develop, in such a way that a capillary gradient develops from the reservoir into the teeth, increasing the flow rate of the hair dye.

In this process it is possible to provide that the second porous material of the teeth is compressed, heating and sticking together. This treatment makes it possible to achieve particularly good compression, as a result of which very small pores form in the teeth, through which the hair dye flows especially rapidly, so that a continuous release flow from the teeth to the hair to be colored is established.

To prevent release of hair dye to the scalp, the invention provides that the pores in the surface area of the free ends of the teeth are closed by means of ultrasound, heating or adhesion, or by applying a closure material, especially a closure cap.

In an embodiment, the invention provides that the teeth are arranged on the housing adjacent to one another at distances of about 0.5 to 1 mm. This tooth interval has proven particularly advantageous, since in this way close contact between the teeth and the hair strands is produced and thus a particularly good release of the hair dye from the teeth to the hair strands takes place.

According to a further embodiment it is provided that the teeth be arranged in at least two rows, staggered with respect to one another, on the housing. As a result of this multi-row, staggered arrangement of the teeth, the hair strands are drawn in wavelike form through the teeth during the combing process, so that a particularly good contact between the hair strands and the teeth is established, and thus a particularly good coloring result is attainable.

In order to clamp the teeth, on which a transverse stress is imposed by the combing process, in a flexurally rigid way in the housing, the housing is equipped with holders at a distance from the tooth roots meshing into the first porous material, wherein the cross section of the holders differs slightly from the round cross section of the teeth. As a result of the slight difference between the cross sections of the holders and the teeth, it is possible to ensure that air can penetrate into the housing, so that no negative pressure can develop in the housing due to release of the hair dye.

It is provided in accordance with a particularly advantageous embodiment of the invention that teeth about 25 to 35 mm long penetrate into the reservoir by about 5 mm and have a diameter of 1.5 to 2.5 mm. In this process, the reservoir extends about 30 to 60 mm in the longitudinal direction of the teeth.

The first porous material of the reservoir and the second porous material of the teeth preferably consist of polyester, nylon, or acrylic. These materials have proven especially advantageous from the viewpoint of storage and release capabilities. For example, at an inherent weight of about 0.07 g, the teeth can take up a liquid volume of 0.05 g. As a result of this high uptake capacity of the teeth, it is possible to release about 1.8 g aqueous solution per minute from the teeth to the hair.

The invention also provides that the first porous material of the reservoir is surrounded by an extruded polyester film. Production is simplified by this design. The porous material is manufactured continuously from very long fibers and compressed by the casing. As a result, corresponding reservoirs can be separated from the long fibers, adapted to the desired reservoir length.

It is especially advantageous if the housing is equipped with a removable, airtight closure covering the teeth. In this way when the device is not being used for hair dyeing it is possible to prevent the teeth from drying out and the pores from becoming clogged, making the device unusable.

In this process it is especially advantageous that an insert of a flexible material with a conical sealing surface be provided for each tooth, reducing the interior space of the closure, which in each case interacts with the corresponding conical sealing surface on the holder. This embodiment causes particularly good sealing of the teeth, so that no evaporation of the hair dye can take place, and thus loss of hair dye can be kept very low.

A particularly simple design is obtained when a housing part, forming the holders for all teeth, is arranged between the housing and the closure.

In addition, the invention provides that connecting means for connection to additional housings are arranged on the outer surface of the housing. In this way several housings may be combined with one another, in which, for example, hair dyes of different colors are stored, so that different hair colorings can be achieved by a single hair dyeing process.

It is advantageous if the reservoir made of the first porous material is arranged interchangeably in the housing. As a result, even after the reservoir has been emptied, a device can be used again by inserting a new reservoir.

It may also be provided that the teeth in one or two reservoirs made of the first porous material are inserted from opposite sides. If the teeth are inserted in only one reservoir, reservoirs with a greater longitudinal length can be used, having greater storage capacity as a result, since then the transport distances from the reservoir to the teeth are shortened.

Finally, it is also possible to provide that several reservoirs with teeth inserted in them are arranged next to one another in a housing. This design is especially suitable for a housing with a plurality of teeth arranged next to one another, wherein an especially large hair surface is colored in one combing process. In this process the usual reservoirs, arranged one beside the other, can be employed.

In the following the invention will be explained in greater detail by way of example on the basis of the drawings. These show the following:

FIG. 1. A greatly enlarged schematic representation of the fiber structure of a nonoriented porous material.

FIG. 2. Likewise a greatly enlarged schematic representation in the penetration area of a tooth into a reservoir, in longitudinal section, made of two materials prepared from the starting material in FIG. 1 but compressed to different degrees, FIG. 3. A section along Line III—III in FIG. 2, FIG. 4. An exemplified embodiment of the invention, in cross section, FIG. 5. The exemplified embodiment according to FIG. 4 in a longitudinal section, FIG. 6. An additional exemplified embodiment in a longitudinal section, FIG. 7. An exemplified embodiment with a single-row arrangement of teeth, perspective view, FIG. 8. An exemplified embodiment with three-row tooth arrangement in perspective view, FIG. 9. An exemplified embodiment with two housings arranged adjacent to one another, and FIG. 10. An additional exemplified embodiment.

FIG. 1 shows an enlarged section from a porous material 1, such as polyester, nylon, or acrylic. Fibers 2 of the porous material 1 do not have a preferred orientation, but are branched in all directions. Pores 3 are formed between the fibers 2 arranged at a distance from one another, and likewise do not show a uniform orientation.

In FIGS. 2 and 3, the starting material 1 is shown after different treatment stages. A first porous material 4 (reservoir 15) and a second porous material 5 (teeth 16) were produced from the starting material 1 by different degrees of compression. The first porous material 4 has largely parallel fibers, between which corresponding parallel pores 7 are formed, having a uniform main pore direction, as indicated by an arrow 8 in the drawing. As a result of the compression of the first porous material 4, the pores 7, to be sure, have been made narrower in diameter compared to the pores 3 of the starting material 1, but they are nevertheless large enough to store a sufficiently large quantity of hair dye.

The second porous material 5 is compressed substantially more extensively than the first porous material, with heating and adhesion of fibers 9. Between the fibers 9, very narrow pores 10 are formed, and like the fibers 9 these are aligned in the main pore direction 8. In the transition region 11 between the first porous material 4 and the second porous material 5, as a result of the different diameters of the pores 7 of the first porous material 4 and the pores 7 of the second porous material 5, a capillary gradient develops, as a result of which the hair dye stored in the first porous material 4 enters the second porous material 5 at an accelerated rate. The hair dye then flows through the pores 10 into a pore margin area 12. When the second porous material 5 now comes into contact with hair strands, not shown in the drawing, the hair dye is released over the pore edge area 12 to the hair.

A first exemplified embodiment of the invention is shown in FIGS. 4 and 5. A device 13 has a housing 14 in which a reservoir 15 made of the first porous material 4 is arranged. In the reservoir 15, teeth 16 made of the second porous material 5 in the area of the tooth roots 17 are inserted in the reservoir 15 adjacent to one another at distances of about 0.5 to 1.0 mm. The tooth roots 17 penetrate about 5 mm into the reservoir 15, which has a longitudinal length of about 40 mm.

In the area of the free ends 18 of the teeth 16, pores 10 of the second porous material 5 of the teeth 16, shown in FIG. 2, are closed by ultrasound, heating or gluing, so that no hair dye can emerge from the free ends 18 of the teeth 16.

Above the reservoir 15 on the housing 14 a housing piece 19 is arranged, which has holders 20 for the teeth 16. The cross sections of these holders 20 differ slightly from the circular cross section of the teeth 16, so that when the device 13 is used, air can penetrate into the housing 14 at any time, and thus a negative pressure can not develop in the housing 14 due to discharge of the hair dye. As a result of the penetration of their tooth roots 17 into the reservoir 15 and guidance in the holders 20, the teeth are arranged in a flexurally rigid way in the housing 14, so that in the case of transverse stress by the combing process they cannot bend or slip out of the housing 14.

When the device 13 is not being used for hair dyeing, a closure 21 covering the teeth 16 is arranged above the housing 14. In the interior space of this closure 21, an insert 22 of a flexible material is formed, which has tubular openings 23 corresponding to the number of teeth 16, which cover the teeth 16. In the opening area of the tubular openings 23, conical sealing surfaces 24 are arranged in each case, which match with corresponding conical sealing surfaces 25 on the holders 20. Through placement of the closure 21 on the housing part 19 and thus the housing 14, the teeth 16 are sealed off airtight from the environment over the sealing surfaces 24 and 25, so that no hair dye can emerge from the teeth 16, and the pores 10 of the teeth 16 cannot be clogged by drying.

As can be seen especially well from FIG. 5, the hair dyeing process with the device 13 takes place as follows: after removal of the closure 21, the teeth 16 are drawn through the hair on the head in a combing movement, so that individual hair strands enter the area between the teeth 16. As a result of the close-set distance between the teeth 16, the hair strands come into contact with the side surfaces of the teeth 16 in this process, so that hair dye is released to the individual hair strands over the pore margin area 12 of the second porous material 5 of the teeth 16. This quantity released is always resupplied continuously from the reservoir 15 to the teeth 16 as a result of the arrangement of the first porous material 4 of the reservoir 15 and the second porous material 5 of the teeth 16, shown in FIGS. 2 and 3. In the exemplified embodiment shown in FIG. 5, a release rate of about 1.8 g aqueous hair dye per minute can be achieved.

FIG. 6 shows an additional exemplified embodiment, wherein the same reference symbols as in FIGS. 4 and 5 with the additional subscript "a" are used. The device **13*a* shows a housing 14*a* which is about three times as wide as the housing 14 according to FIG. 5. In the housing 14*a*, three reservoirs 15*a* are arranged one beside the other, wherein the first porous material 4 is in each case surrounded by a polyester film 26. The teeth 16*a* are correspondingly inserted one beside the other into the reservoir 15*a*. With this device 13*a*, a substantially larger hair area can be colored with a single combing process compared to the device 13 from FIG. 5**.

Figure 7:
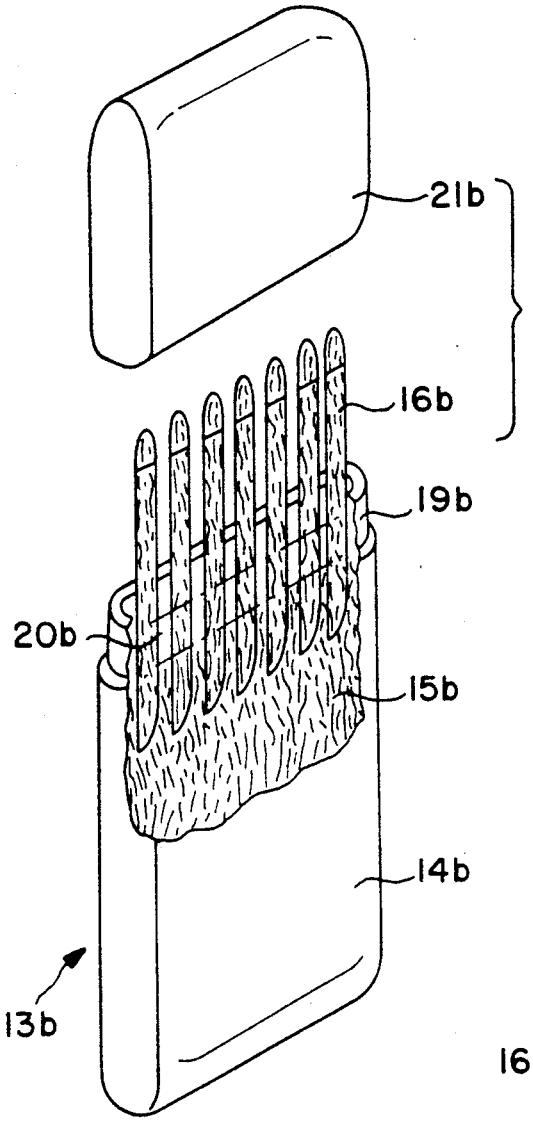
Figure 8:
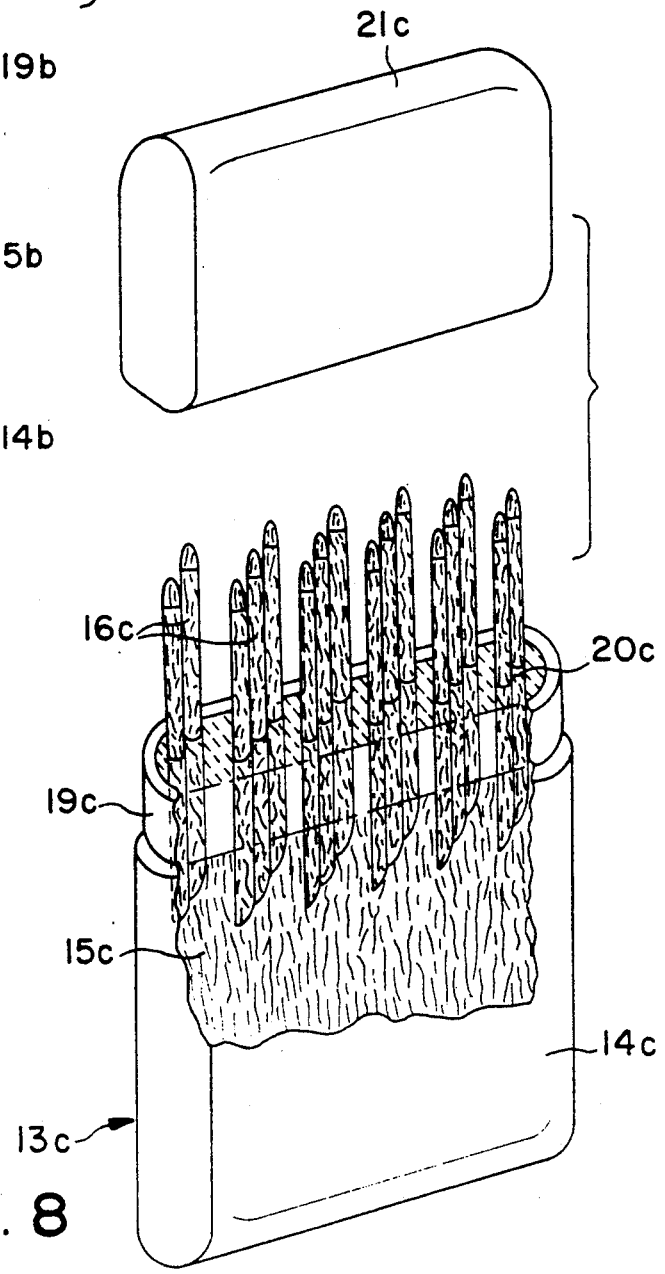

In FIGS. 7 and 8, in a perspective view, two variant embodiments of the invention are shown, wherein the same symbols are used as in FIGS. 4 and 5, with the additional subscripts "b" and "c". According to FIG. 7, the teeth **16*b* of the device 13 are arranged in a row one beside the other at equal intervals. On the other hand, the device 13*c* in FIG. 8 shows a three-row arrangement of the teeth 16*c*, wherein the teeth 16*c* are arranged staggered with respect to one another. With this multi-row, staggered arrangement of the teeth 16*c*, a particularly advantageous hair coloring can be achieved, since the hair strands are drawn in a wavelike form through the teeth 16*c*** and thus a particularly close contact develops between the hair strands and the teeth.

Figure 9:
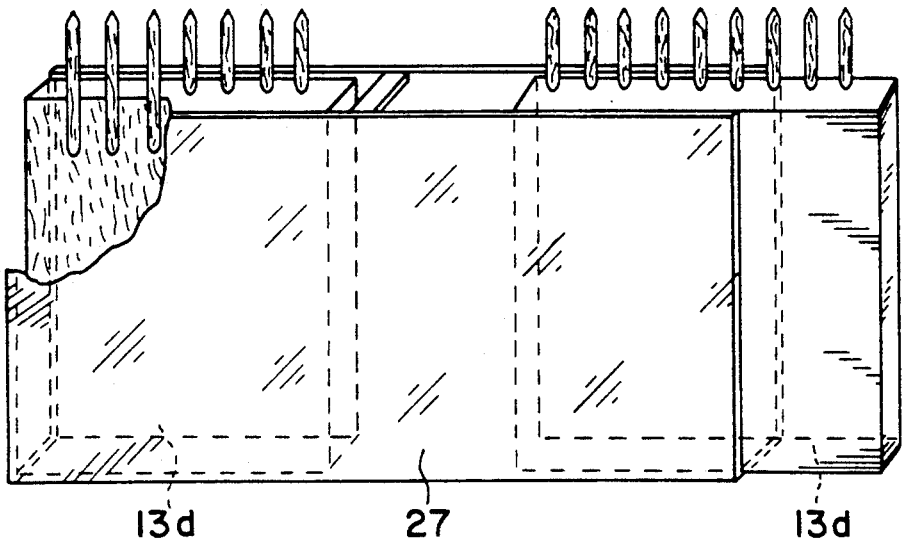

FIG. 9 shows an additional exemplified embodiment, wherein the same symbols are used as in FIGS. 4 and 5, with the additional subscript "d". In a housing 27, two devices **13*d* are inserted, wherein for illustration the one device is shown in a half-inserted state. With this embodiment several dyeing devices 13*d*** can be combined, for example having reservoirs with hair dyes of different colors. In this way hair strands of different colors can be produced.

Figure 10:
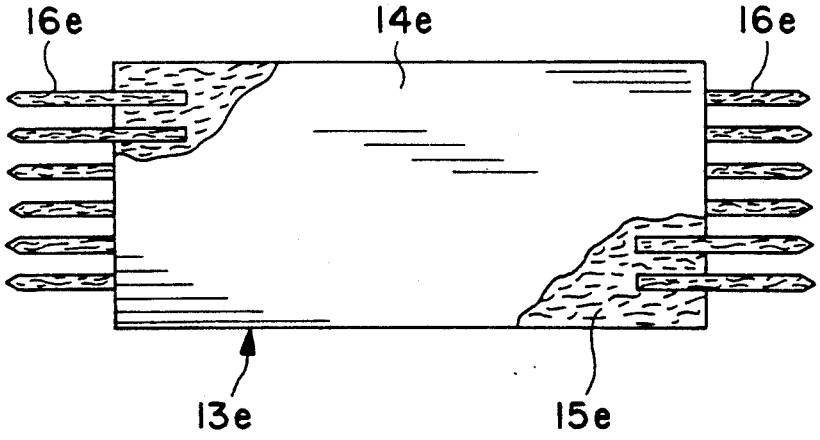

An additional variant of the invention is shown in FIG. 10, wherein here the reference codes are provided with the subscript "e". In this process, the teeth **16*e* are inserted from opposite sides into the reservoir 15*e* made of the first porous material. The reservoir 15*e* can be made longer in the lengthwise direction, since the transport paths from the reservoir 15*e* to the teeth 16*e*** are shorter as a result of the bilateral design.

Naturally the invention is not limited to the exemplified embodiments shown in the drawing. Additional embodiments of the invention are possible without departing from the basic concept.

Thus naturally, besides the use of hair dyes, the use of conditioners or the like is possible, as are other developments.

What is claimed is:

1. A device for continuously releasing a hair dye onto human head hair, said device comprising a reservoir for the hair dye, said reservoir consisting of a first porous material within a housing and teeth made of a second porous material set into the first porous material and in capillary connection with it, wherein the first porous material of the reservoir extends in the penetration direction over several times the penetration depth of the teeth, wherein the improvement comprises the teeth having closed pores in the surface area of their free ends so that no hair dye can flow from these free ends, the main pore direction of the second porous material of the teeth and of the first porous material of the reservoir being essentially in the same direction as and parallel to the longitudinal direction of the teeth, and the pores of the first porous material being larger than the pores of the second porous material.

2. A device in accordance with claim 1, wherein the first porous material of the reservoir and the second porous material of the teeth (16) are formed by compression from nonoriented, fibrous material and the compression of the second porous material is greater than that of the first material.

3. A device in accordance with claim 1 wherein the second porous material of the teeth is compressed under heating so as to produce inter-fiber adhesion.

4. A device in accordance with claim 1 wherein the pores in the surface area of the free ends of the teeth have been closed by a method selected from the group consisting of ultrasound, heating, adhesion, and applying a closing cap.

5. A device in accordance with claim 1 wherein the teeth are arranged at a spacing of about 0.5 to 1 millimeter from one another in the housing.

6. A device in accordance with claim 1 wherein the teeth are arranged in at least two rows, staggered against one another, on the housing.

7. A device in accordance with claim 1 wherein the housing, at a distance from the teeth roots extending into the first porous material, is equipped with holders, the teeth have a round cross section, and the cross section of the holders is different from the round cross section of the teeth.

8. A device in accordance with claim 1 wherein teeth that are from about 25 to 35 mm long penetrate about 5 mm into the reservoir and have a diameter of 1.5 to 2.5 mm.

9. A device in accordance with claim 1 wherein the reservoir extends for about 30 to 60 mm in the longitudinal direction of the teeth.

10. A device in accordance with claim 1 wherein the first porous material of the reservoir and the second porous material of the teeth consist of polyester, nylon, or acrylic.

11. A device in accordance with claim 10, wherein the first porous material of the reservoir is enveloped by an extruded polyester film.

12. A device in accordance with claim 1 wherein the housing is equipped with a removable airtight closure covering the teeth.

13. A device in accordance with claim 12, wherein the housing is equipped with a holder for the teeth and in the closure, an insert made of a flexible material with a conical sealing surface for each tooth, reducing the interior space of the closure, is arranged and interacts with a corresponding conical sealing surface on the holder.

14. A device in accordance with claim 13, wherein a housing part forming the holders for all the teeth is arranged between the rest of the housing and the closure.

15. A device in accordance with claim 1 wherein connecting means for connection to additional housings are arranged on the outer surface of the housing.

16. A device in accordance with claim 1 wherein the reservoir made of the first porous material is replaceable in the housing.

17. A device in accordance with claim 1 wherein the teeth are inserted in one or two reservoirs made of the first porous material from opposite sides.

18. A device in accordance with claim 1 wherein a plurality of reservoirs with teeth set into them are arranged adjacent to one another in a housing.

* * * * *